US010154940B2

(12) United States Patent
Wang

(10) Patent No.: US 10,154,940 B2
(45) Date of Patent: Dec. 18, 2018

(54) MASSAGE STICK

(71) Applicant: Kuan Chih Wang, Tainan (TW)

(72) Inventor: Kuan Chih Wang, Tainan (TW)

( * ) Notice: Subject to any disclaimer, the term of this patent is extended or adjusted under 35 U.S.C. 154(b) by 440 days.

(21) Appl. No.: 14/949,901

(22) Filed: Nov. 24, 2015

(65) Prior Publication Data

US 2017/0143581 A1 May 25, 2017

(51) Int. Cl.
*A61H 15/00* (2006.01)
*A61H 7/00* (2006.01)

(52) U.S. Cl.
CPC ..... *A61H 15/0092* (2013.01); *A61H 7/007* (2013.01); *A61H 2015/0014* (2013.01); *A61H 2201/1635* (2013.01)

(58) Field of Classification Search
CPC ..... A61H 15/0092; A61H 2015/0007; A61H 2015/0014
See application file for complete search history.

(56) References Cited

U.S. PATENT DOCUMENTS 3,616,794 A * 11/1971 Gramala ..... A61H 15/0092 482/132
4,945,900 A * 8/1990 Masuda ..... A61H 15/0092 601/120
5,566,995 A * 10/1996 Jagiela ..... E05B 15/0205 292/340
5,575,760 A * 11/1996 Masuda ..... A61H 15/0092 601/119
5,637,065 A * 6/1997 Chang ..... A63B 23/14 482/1
6,974,427 B1 * 12/2005 Lapham ..... A61H 15/00 601/120
9,174,082 B1 * 11/2015 Marlow ..... A63B 23/0205
2008/0004553 A1 * 1/2008 Tsai ..... A61H 15/0092 601/120
2008/0200851 A1 * 8/2008 Faussett ..... A61H 15/0092 601/119
2012/0310125 A1 * 12/2012 Hall ..... A61H 15/0085 601/120

* cited by examiner

*Primary Examiner* — Timothy A Stanis

(57) ABSTRACT

A massage stick includes a rod, a massage tube, two tube stoppers, two handles and two heads. The rod extends through the massage tube and each tube stopper is fixed on one end of the rod. Each tube stopper has a step in a hole thereof. The two handles are mounted to two ends of the rod and each has a passage in which two shoulders and a contact face are formed. The two heads are respectively connected to the two handles, and each has a shank and a massage end. The user may hold the handles and roll the massage tube to massage the body. Alternatively, the user may hold the massage tube and roll the handles to massage the body. The user may hold the handles or the massage tube, using the massage ends of the heads to massage the body.

2 Claims, 4 Drawing Sheets

MASSAGE STICK

BACKGROUND OF THE INVENTION

1. Fields of the Invention

The present invention relates to a massage stick, and more particularly, to a massage stick having a massage tube with two handles on two ends thereof, each handle having uneven massage portion for body massage.

2. Descriptions of Related Art

The conventional massage stick comprises a shaft with multiple rollers on the middle portion thereof, each roller has protrusions formed on the outside thereof. The user holds the two ends of the shaft and rolls the rollers back and forth on a specific body part to make the protrusions massage the specific body part. However, there is no massage function on each end of the shaft of the conventional massage stick, resulting in some body parts unable to be massaged by rolling the roller.

The present invention intends to provide a massage stick to eliminate the shortcomings mentioned above.

SUMMARY OF THE INVENTION

The present invention relates to a massage stick and comprises a rod which is provided with two threaded portions at its two ends and extends through a passage in a massage tube. Two tube stoppers are provided at the massage stick. Each tube stopper defines a hole including a first segment and a second segment, wherein the first segment has a diameter greater than the second segment, thus forming a step therebetween. Each tube stopper has an annular surface formed coaxially with the hole. Two ends of the massage tube are inserted into the first segments of the holes of the tube stoppers, so that the massage tube is fixed between the tube stoppers. Two handles are provided at the massage stick, each handle having a first end and a second end. Each handle has a passage defined axially therethrough. A shoulder is defined in the inner periphery of each end of the passage of each handle. A contact face is formed in the inner periphery of the second end of each handle and located between the passage of each handle and the end face of the second end of each handle. Each handle has a massage portion formed on an outside thereof. Two first bearings are mounted such that each first bearing is located on the shoulder at one end of the passage of each handle, wherein the annular surface of each tube stopper contacts one end surface of a corresponding first bearing. Two second bearings are mounted such that each second bearing is located on the shoulder at an opposite end of the passage of each handle. A sleeve is fitted around the rod, between corresponding first and second bearings in each handle. Two nuts are mounted such that each nut is threadedly connected with one of the threaded portions of the rod, wherein a washer is placed between a corresponding second bearing and a corresponding nut, so that the first and second bearings, and the rod are fastened together by the nuts. Two heads each has a shank and a massage end, wherein the shank is force-fitted into the second end of a corresponding handle and engaged with the contact face corresponding thereto.

The primary object of the present invention is to provide a massage stick which not only has massage tube in the middle of the massage stick but also has a massage portion on the handles so as to massage different body parts.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
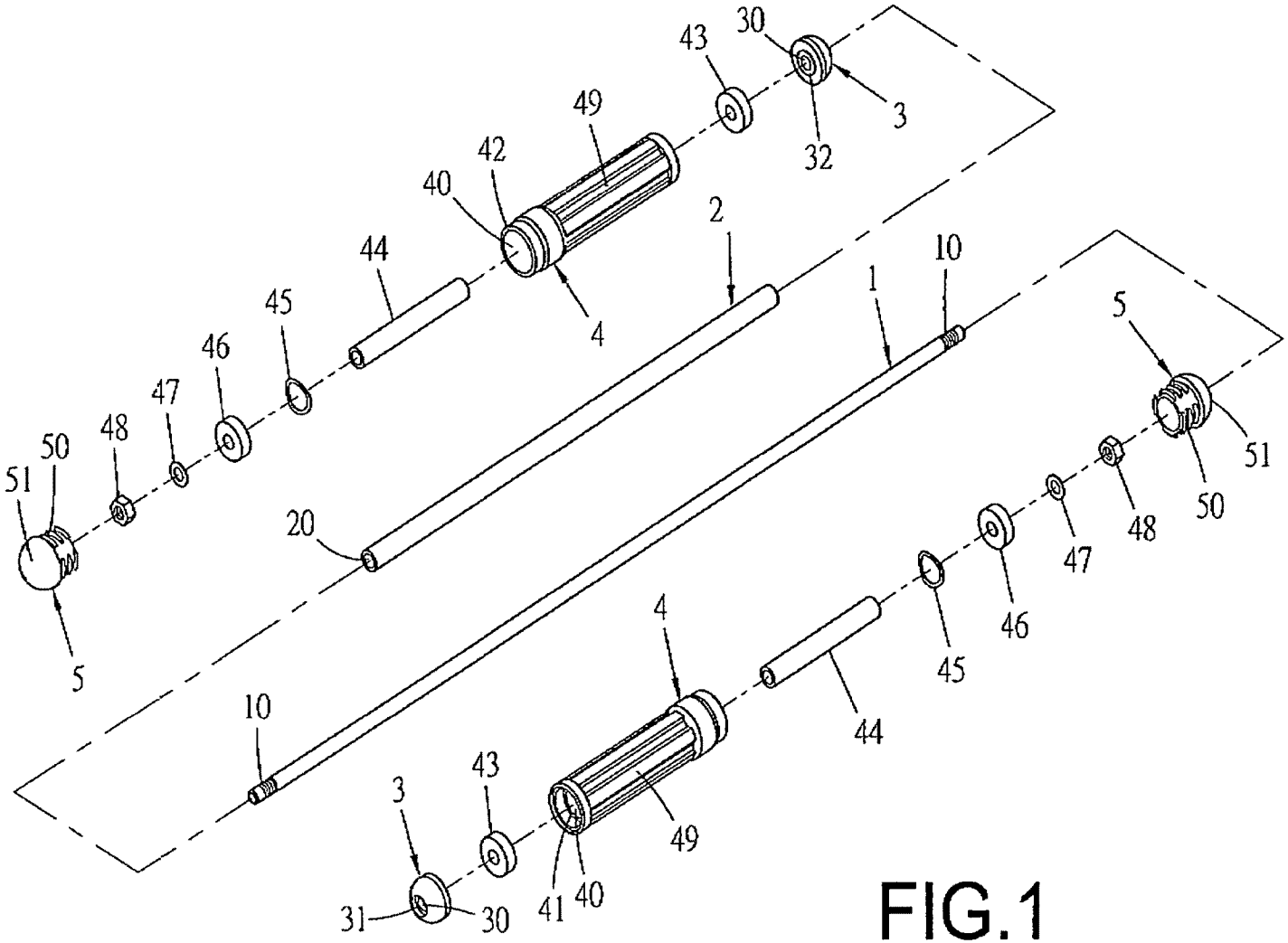
FIG. 1 is an exploded view of one embodiment of the massage stick of the present invention.
Figure 2:
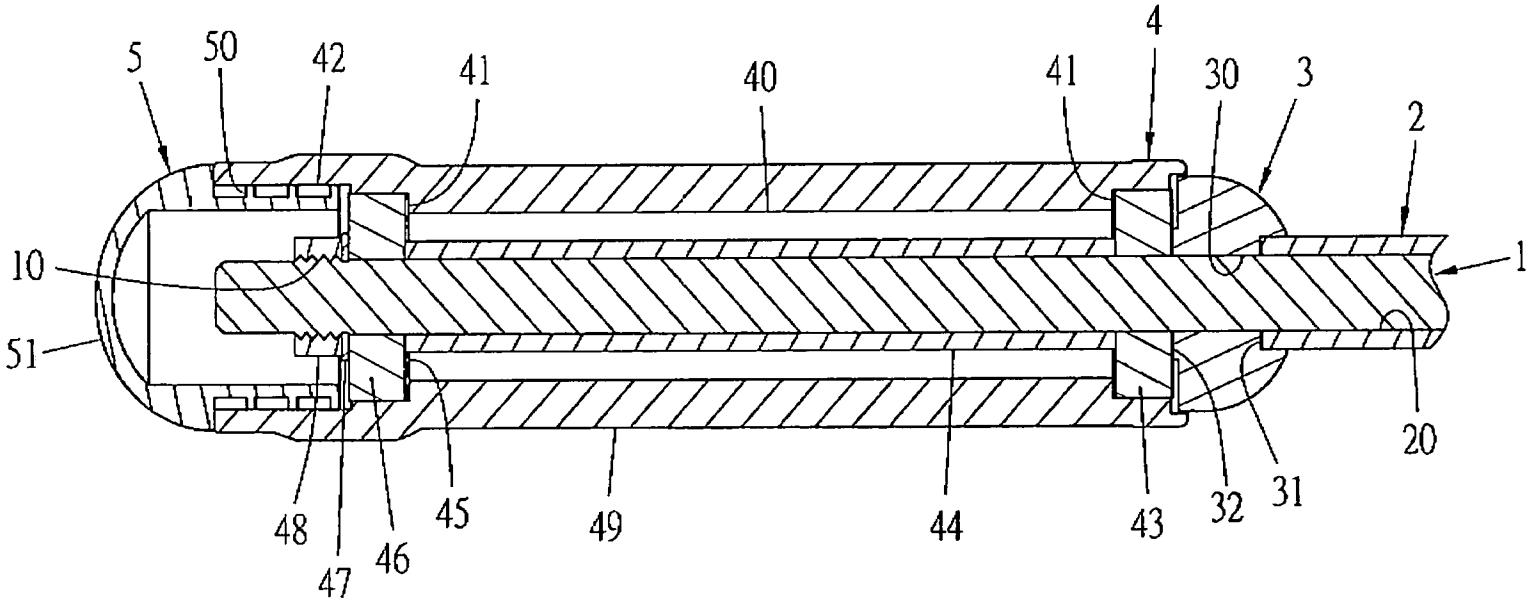
FIG. 2 is a cross sectional view of the massage stick to show the connection of the handle, the head and the rod on each end of the massage stick of the present invention.
Figure 3:
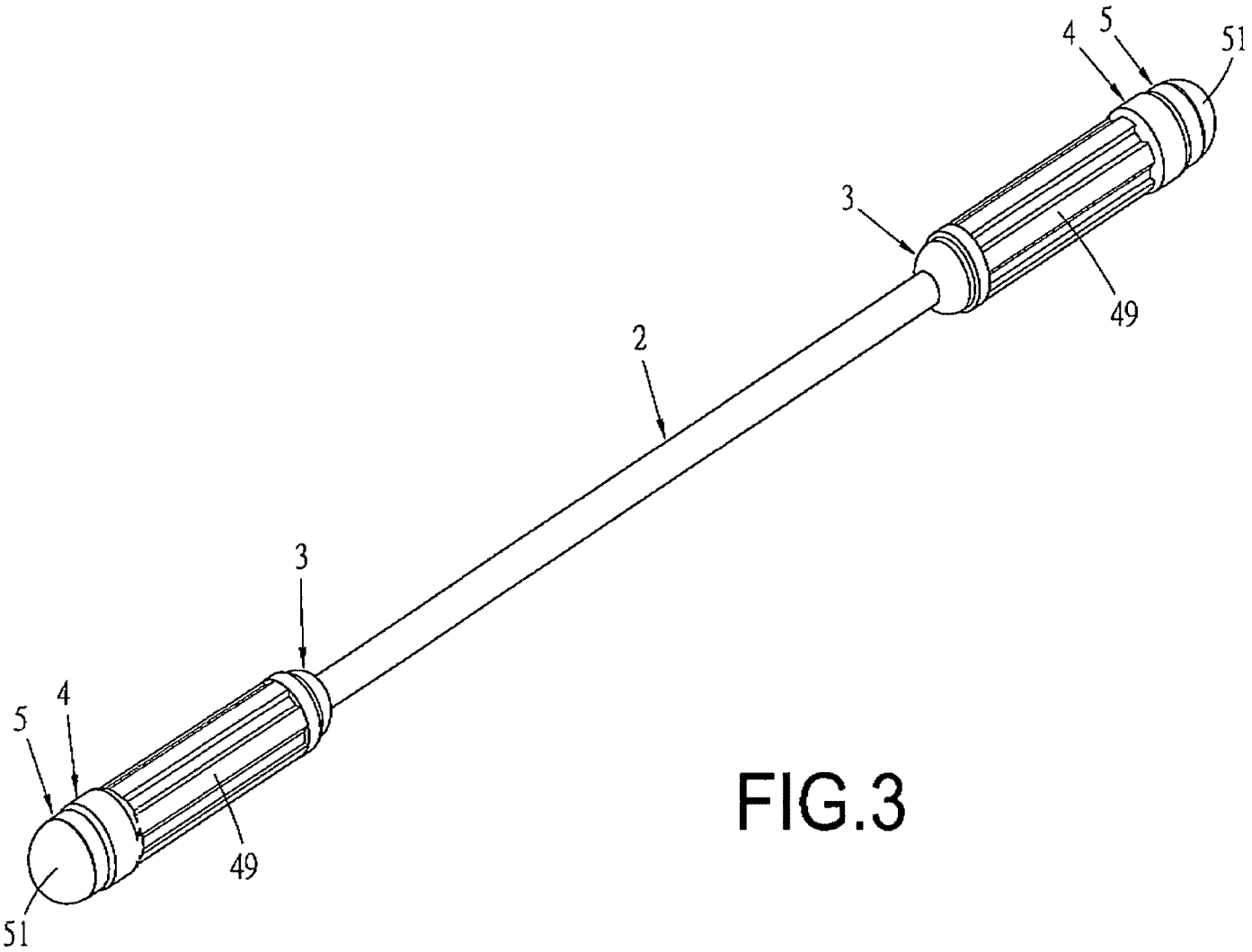
FIG. 3 is a perspective view of the massage stick to show the massage stick of the present invention.

Referring to FIGS. 1 through 3, one embodiment of the massage stick of the present invention comprises a rod 1, a massage tube 2, two tube stoppers 3, two handles 4 and two heads 5. The rod 1 has two threaded portions 10 formed on two ends thereof. The massage tube 2 has a passage 20 defined axially therethrough and the rod 1 extends through the passage 20 of the massage tube 2.

Each tube stopper 3 defines a hole 30 including a first segment and a second segment, wherein the first segment has a diameter greater than the second segment, thus forming a step 31 therebetween. Also, each tube stopper 3 has an annular surface 32 formed coaxially with the hole 30 thereof. Two ends of the massage tube 2 are inserted into the first segments of the tube stoppers 3, so that the massage tube 2 is fixed between the tube stoppers 3. The two handles 4, made of rubber or plastics to reduce the manufacturing cost, are mounted to the two ends of the rod 1 respectively, and each handle 4 has a first end and a second end. Each handle 4 has a passage 40 defined axially therethrough, and a shoulder 41 is defined in the inner periphery of each end of the passage 40 of each handle 4. A contact face 42 is formed in the inner periphery of the second end of each handle 4 and located between the passage 40 of each handle 4 and the end face of the second end of each handle 4. Each handle 4 has a massage portion 49 formed on the outside thereof. There are two first bearings 43 and two second bearings 46 disposed in the massage stick. Each of the two first bearings 43 is located on the shoulder 41 at one end of the passage of a corresponding handle 4, wherein the annular surface 32 of each tube stopper 3 contacts one end surface of a corresponding first bearing 43; each of the two second bearings 46 is located on the shoulder 41 at an opposite end of the passage 40 of a corresponding handle 4. There are two nuts 48 used in the massage stick. Two sleeves 44 are fitted around the rod 1, wherein each sleeve 44 is located between corresponding first and second bearings 43, 46. Each nut 48 is threadedly connected with one of the threaded portions 10 of the rod 1, wherein a first washer 45 is placed between the sleeve 44 in each handle 4 and a corresponding second bearing 46, and a second washer 47 is placed between a corresponding second bearing 46 and a corresponding nut 48, so that the first and second bearings 43, 46, and the rod 1 are fastened together by the nuts with the assistance of the washers 45, 47. Two heads 5 each has a shank 50 and a massage end 51. The heads 5 are made of rubber or plastics to reduce the manufacturing cost. The shanks 50 are force-fitted into the second ends of the handles 4 and engaged with the contact faces 42 corresponding thereto.

As shown in FIGS. 1 to 3, when assembling the massage stick, the rod 1 extends through the passage 20 of the massage tube 2. Two tube stoppers 3 are fixed on the rod 1 respectively through the hole 30 of each tube stopper 3. The steps 31 of tube stoppers 3 are abutted against the two ends of the massage tube 2. The first bearings 43 are mounted to the rod 1 and are abutted on the tube stoppers 3. Two handles 4 are mounted to the rod 1 and each first bearing 43 is located between a corresponding tube stopper 3 and the shoulder 41 in the first end of a corresponding handle 4, wherein the annular surface 32 of each tube stopper 3 contacts one end surface of a corresponding first bearing 43. The sleeves 44 are mounted to the rod 1 and located between the first and second ends of the handles 4. The first washers 45 are mounted to the rod 1 between the sleeves 44 and the first bearings 43. The second bearings 46 are mounted to the rod 1 and located between the first washers 45 and the second washers 47. The nuts 48 are threadedly connected to the threaded portions 10 of the rod 1 respectively and are abutted against the second washers 47. The heads 5 are then connected to the second ends of the handles 4 respectively, and the shanks 50 are force-fitted into the second ends of the handles 4 and engaged with the contact faces 42 corresponding thereto.

Figure 4:
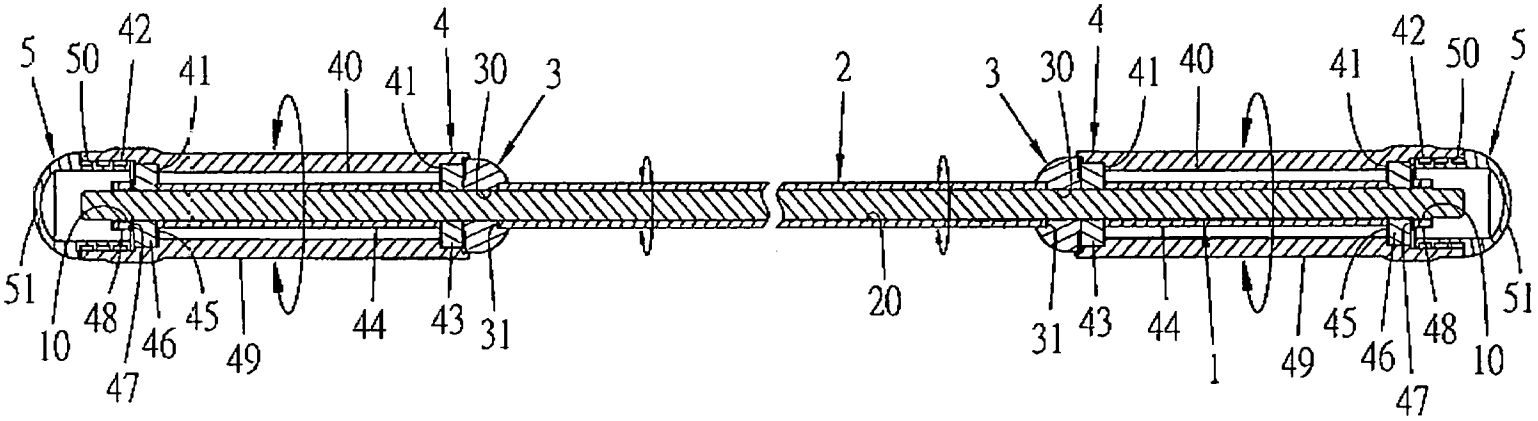
FIG. 4 is a cross sectional view of the massage stick to show the operation of the massage stick of the present invention.

When in use, as shown in FIG. 4, the user may hold the massage portions 49 of the two handles 4, and roll the massage tube 2 back and forth to massage the body. Alternatively, the user may hold the massage tube 2 and roll the handles 4, using the massage portions 49 to massage the body. Alternatively, the user may hold the massage tube 2 or the massage portions 49 of the handles 4, using the massage ends 51 to massage the body. Therefore, the massage stick of the present invention provides various ways to massage every body parts and is easy to use.

While we have shown and described the embodiment in accordance with the present invention, it should be clear to those skilled in the art that further embodiments may be made without departing from the scope of the present invention.

What is claimed is:

1. A massage stick comprising:

a rod provided with two threaded portions at its two ends;

a massage tube having a passage defined axially therethrough and the rod extending through the passage of the massage tube;

two tube stoppers each defining a hole including a first segment and a second segment, the first segment having a diameter greater than the second segment, thus forming a step therebetween, each tube stopper having an annular surface formed coaxially with the hole thereof, two ends of the massage tube being inserted into the first segments of the tube stoppers so that the massage tube is fixed between the tube stoppers;

two handles each having a first end and a second end, each handle having a passage defined axially therethrough, a shoulder defined in an inner periphery of each end of the passage of each handle, a contact face formed in an inner periphery of the second end of each handle and located between the passage of each handle and an end face of the second end of each handle, each handle having a massage portion formed on an outside thereof;

two first bearings each being located on the shoulder at one end of the passage of a corresponding handle, wherein the annular surface of each tube stopper contacts one end surface of a corresponding first bearing;

two second bearings each being located on the shoulder at an opposite end of the passage of a corresponding handle;

a sleeve fitted around the rod, between corresponding first and second bearings in each handle;

two nuts each being threadedly connected with one of the threaded portions of the rod, wherein a washer is placed between a corresponding second bearing and a corresponding nut, so that the first and second bearings, and the rod are fastened together by the nuts; and two heads each having a shank and a massage end, the shank force-fitted into the second end of a corresponding handle and engaged with the contact face corresponding thereto;

whereby the first and second bearings and the rod are configured to be rotated simultaneously about the two handles and the tube stoppers while the massage stick conducts a massage activity.

2. The massage stick of claim 1, wherein another washer is placed between the sleeve and the second bearing in each handle.

* * * * *